United States Patent [19]

Shiba et al.

[11] Patent Number: 4,555,461

[45] Date of Patent: Nov. 26, 1985

[54] PROCESS FOR PREPARING A LITHOGRAPHIC PRINTING PLATE

[75] Inventors: Keisuke Shiba; Tetsuro Fuchizawa; Sho Nakao; Chikashi Ohishi, all of Shizuoka, Japan

[73] Assignee: Fuji Photo Film Co., Ltd., Kanagawa, Japan

[21] Appl. No.: 715,997

[22] Filed: Mar. 26, 1985

Related U.S. Application Data

[63] Continuation of Ser. No. 427,037, Sep. 29, 1982, abandoned.

[30] Foreign Application Priority Data

Oct. 1, 1981 [JP] Japan ..... 56-156829

[51] Int. Cl.[4] ..... G03G 5/10; G03G 13/26

[52] U.S. Cl. ..... 430/49; 430/60; 430/62

[58] Field of Search ..... 430/49, 60, 62, 63, 430/96

[56] References Cited

U.S. PATENT DOCUMENTS

| | | | |
|---|---|---|---|
| 3,315,600 | 4/1967 | Tomanek | 430/49 |
| 3,732,418 | 5/1973 | Lind | 430/49 |
| 4,069,759 | 1/1978 | Endo et al. | 430/49 |
| 4,259,425 | 3/1981 | Serlin | 430/97 |

*Primary Examiner*—John L. Goodrow

*Attorney, Agent, or Firm*—Sughrue, Mion, Zinn, Macpeak & Seas

[57] ABSTRACT

An electrophotographic plate making material comprising a substrate comprising a paper support and a polyolefin laminate layer on at least one surface thereof and having a volume resistance of $10^{10}$ ohms or less, and a photoconductive layer on the substrate.

17 Claims, No Drawings

PROCESS FOR PREPARING A LITHOGRAPHIC PRINTING PLATE

This is a continuation of application Ser. No. 427,037, filed Sept. 29, 1982 now abandoned.

FIELD OF THE INVENTION

The present invention relates to a material from which a lithographic printing plate can be made by electrophotography. More particularly, the invention relates to an electrophotographic plate making material from which a lithographic printing plate having a high printing durability can be made by using a substrate including a paper support.

BACKGROUND OF THE INVENTION

A method for preparing a lithographic printing plate by electrophotography is known. The method comprises uniformly charging the photoconductive layer of an electrophotographic plate making material, subjecting the charged plate making material to imagewise exposure, developing the image by either a wet or dry method to provide a toner image, fixing the toner image and treating the photoconductive layer with a desensitizing solution (etching solution) to render the nonimage area (without a toner image) hydrophilic to thereby produce a lithographic printing plate.

Electrophotographic plate making materials using a paper support are known, but a lithographic printing plate made from these materials has a printing durability such that only about 3,000 sheets can be printed. The main reason for such a low degree of printing durability is due to penetration of water into the paper substrate. Penetration of the etching solution (aqueous solution) during the desensitization treatment of the nonimage area after plate making and also penetration of dampening water during printing occur. As a result, a paper substrate absorbs water and swells, and in some cases, the paper substrate peels off from the photoconductive layer.

On the other hand, regarding image quality, for example, dot reproducibility, stable reproducibility is up to about 100 lines/inch.

One reason for this is that the water content in the support varies depending upon the temperature and humidity conditions of the atmosphere during exposure, which changes the electric conductivity of and adversely affects the photographic characteristics of the printing plate.

Various methods have been proposed to overcome these problems. One method comprises forming an intermediate layer between the paper support as a substrate and the photoconductive layer. Japanese Patent Application (OPI) No. 138904/75 discloses formation of an intermediate layer of an epoxy resin; Japanese Patent Application (OPI) No. 105580/80 discloses formation of an intermediate layer of ethylene derivatives such as ethylene-acrylic acid copolymers, ethylene-methacrylic acid copolymers, ethylene-vinyl acetate copolymers, ethylene-vinyl acetate-vinyl chloride copolymers and ethylene ionomers; and Japanese Patent Application (OPI) No. 14804/79 discloses formation of an intermediate layer prepared by coating and drying an aqueous polyethylene emulsion containing carbon black or graphite. However, none of the electrophotographic plate making materials using those intermediate layers provide a lithographic printing plate having excellent printing durability.

SUMMARY OF THE INVENTION

Therefore, one object of the present invention is to provide an electrophotographic plate making material from which a lithographic printing plate having good dimensional stability and excellent printing durability can be produced.

Another object of the present invention is to provide an electrophotographic plate making material with less change in photographic characteristics under various temperature and moisture conditions.

Still another object of the present invention is to provide an electrophotographic plate making material with good handling characteristics, particularly high adaptability to processing with automatic plate making machines.

As a result of various studies on electrophotographic plate making materials, it has been found that the above objects are achieved by employing an electrophotographic plate making material wherein a photoconductive layer is formed on at least one surface of a substrate having a volume resistance of about $10^{10}$ ohms or less and which comprises a paper support and laminated on at least one surface thereof a polyolefin laminate layer.

DETAILED DESCRIPTION OF THE INVENTION

Suitable polyolefins which can be laminated on the paper support are polyethylenes, polypropylenes, polybutylenes, polypentenes, etc., with polyethylenes and polypropylenes being preferred. Particularly preferred polyethylenes are those having a density of about 0.92 to 0.96 g/cm$^3$, an average molecular weight of about 20,000 to 50,000, a softening point of about 110° to 130° C., a tensile strength of 130 to 300 kg/cm$^2$ and a specific volume resistance of about $10^{15}$ ohms.cm or more, and particularly preferred polypropylenes are those having a density of about 0.85 to 0.92 g/cm$^3$, a softening point of about 75° to 170° C., a tensile strength of about 280 to 420 kg/cm$^2$ and a specific volume resistance of about $10^{15}$ ohms.cm or more. Polyethylene is most preferred as a polyolefin.

An electroconductive material is present in the polyolefin laminate layer in an amount such that the substrate ultimately obtained has a volume resistance of about $10^{10}$ ohms or less. This minimizes the change of the photographic characteristics of the resulting printing plate due to changes in humidity (particularly, at lower humidity) and provides the ability to produce a lithographic printing plate having a good image quality and excellent printing durability. Particularly preferred electroconductive materials are metal oxides described, for example, in French Pat. No. 2,277,136 and U.S. Pat. No. 3,597,272, such as fine particles of oxides of metals selected from zinc, magnesium, tin, barium, indium, molybdenum, aluminum, titanium and silicon, preferably crystalline oxides or composite oxides thereof; or carbon black. Exemplary metal oxides include electroconductive zinc oxide, electroconductive tin oxide and electroconductive titanium oxide. Of these, electroconductive carbon black is inexpensive and highly miscible with polyolefins and can be advantageously used.

These electroconductive materials are used in an amount such that the volume resistance of the substrate ultimately obtained is about $10^{10}$ ohms or less, preferably $10^8$ ohms or less, and most preferably $10^6$ ohms or less. The amount of the electroconductive materials to achieve the above resistance value varies depending upon the type of the paper support, polyolefin and the electroconductive materials used but the electroconductive materials can generally be used in an amount of about 5 to 30 wt% based on the weight of the polyolefins.

These polyolefins are laminated onto at least one, preferably both surfaces of a paper support and this is one of the characteristics of the present invention. The lamination of a polyolefin layer makes it possible to obtain an electrophotographic plate making material which provides the ability to produce a lithographic printing plate having a good image quality and excellent printing durability. Various conventional methods such as the wet method, the dry method, the hot melt method and the extrusion method can be used as the laminating method. The extrusion method is particularly preferred in the present invention. This method comprises melting the polyolefin, shaping it into a film, immediately press bonding the film to the paper support and then cooling the film. Many apparatuses are known to perform the extrusion method.

A suitable thickness of the polyolefin layer is in the range of from about 5 to 50μ. If it is thinner than about 5μ, the paper support is not sufficiently waterproof and on the other hand, if it is thicker than about 50μ, no further improvement in the effect is achieved, resulting in merely increasing the cost. The preferred thickness is from 10 to 30μ.

To increase the adhesive strength between the paper support and the polyolefin laminate layer, it is preferred for the paper support to be previously coated with polyethylene derivatives such as an ethylene-vinyl acetate copolymer, ethylene-acrylate ester copolymer, ethylene-methacrylate ester copolymer, ethylene-acrylic acid copolymer, ethylene-methacrylic acid copolymer, ethylene-acrylonitrile-acrylic acid copolymer and ethylene-acrylonitrile-methacrylic acid copolymer or the surface of the paper support to be previously subjected to corona discharge treatment. A suitable coating amount for these materials is 0.5 to 1 g/m$^2$, although this is not an essential range. Alternatively, the paper support can be subjected to the surface treatments described, for example, in Japanese Patent Application (OPI) Nos. 24126/74, 36176/77, 121683/77, 2612/78 and 111331/79 and Japanese Patent Publication No. 25337/76.

The paper support used in the present invention can be any of the conductive paper supports which have heretofore been used in electrophotographic sensitive materials, such as those prepared by impregnating ion transfer materials or electroconductive materials such as inorganic metal compounds or carbon black as described in U.S. Pat. No. 3,597,272 and French Pat. No. 2,277,136 into a paper or blending those into a paper during paper making; synthetic papers as described in Japanese Patent Publication Nos. 4239/77, 19031/78 and 19684/78. Suitable paper supports which can be used include, for example, chemical pulps, kraft pulps, mixtures of chemical pulps and kraft pulps, synthetic resin papers, etc.

The photoconductive layer formed on the substrate comprises a photoconductive material and a binder. Examples of suitable photoconductive materials are inorganic photoconductive materials such as zinc oxide, cadmium sulfide or titanium oxide, and organic photoconductive materials such as phthalocyanine dyes and polycinnamic acid compounds. Examples of suitable binders include homopolymers and copolymers, such as silicone resins, polystyrene, polyacrylate or polymethacrylate esters, polyvinyl acetate, polyvinyl chloride, polyvinyl butyral and derivatives thereof. A suitable weight ratio of the photoconductive material to the binder is from about 3:1 to 20:1. If desired, sensitizers or coating aids can be added to the photoconductive layer.

The photoconductive layer is formed on the polyolefin laminate layer of the support. The polyolefin laminate layer is preferably previously subjected to surface treatments such as a corona discharge treatment, a glow discharge treatment, a flame treatment, an ultraviolet radiation treatment, an ozone treatment or a plasma treatment as described, for example, in U.S. Pat. No. 3,411,908 so that the adhesive strength between the polyolefin laminate layer and the photoconductive layer is increased. A suitable thickness of the photoconductive layer is from about 5 to 30μ.

A particularly preferred embodiment of the present invention comprises an intermediate layer containing colloidal silica and/or alumina formed between the polyethylene laminate layer of the support and the photoconductive layer. The intermediate layer is formed by dissolving a resin serving as a binder for colloidal alumina and silica in an aqueous medium or occasionally a solvent, introducing colloidal alumina or silica thereinto in the form of a powder or liquid dispersion, mixing them in a conventional manner such as by stirring with a propeller or dispersing with ultrasonic waves and coating the resulting mixture onto the polyolefin laminate layer using conventional methods. The colloidal silica and alumina generally have a particle diameter of about 1 to 100 μm and are available in the form of an aqueous dispersion. Some grades of these dispersions have high miscibility with organic solvents. Furthermore, the colloidal silica and alumina are available in the form of a methanol dispersion. Therefore, there is no particular limitation on the resin used as the intermediate layer. Examples of suitable resins include polyethylene terephthalate, polyimide, polycarbonate, polyacrylate, polymethyl methacrylate, polyvinyl fluoride, polyvinyl chloride, polyvinyl acetate, polystyrene, styrene-butadiene copolymers, polymethacrylate, silicone resins, chlorinated rubbers, epoxy resins, pure and modified alkyd resins, polyethylmethacrylate, poly-n-butyl methacrylate, cellulose acetate, ketone resins, polyethylene, polypropylene, polyacrylonitrile, rosin derivatives, polyvinylidene chloride, nitrocellulose, phenol-formaldehyde resins, metacresol-formaldehyde resins, styrene-maleic anhydride copolymers, polyacrylic acid-polyacrylic acid amide copolymers, fumaric acid-ethylene glycol copolymers, methyl vinyl ether-maleic anhydride copolymers, acryloylglycine-vinyl acetate copolymers, polyvinyl pyrrolidone, polyvinyl alcohol, polyamides, halogenated styrenes, etc. A suitable coating amount for the intermediate layer is generally from about 0.01 to 10 g/m$^2$.

A lithographic printing plate can be prepared using the electrophotographic plate making material of the present invention using conventional methods. For example, the photoconductive layer can be uniformly charged by suitable means such as a corona discharge; the photoconductive layer is subjected to imagewise exposure to form an electrostatic latent image; toner particles are deposited in an imagewise pattern using the wet or dry method and fixed by heating or other suitable means. Then, the nonimage area free from toner particles is treated with a desensitizing solution to render the area hydrophilic. Examples of desensitizing solutions which can be used are compositions containing ferrocyanide or ferricyanide compounds as described in U.S. Pat. No. 4,116,698 and compositions containing metal complex salts as described in U.S. Pat. No. 4,282,811. The lithographic printing plate thus prepared is then mounted on an offset printing machine, and more than 10,000 sheets of printed copies having excellent image quality can be produced using conventional printing methods.

The substrate of the electrophotographic plate making material of the present invention has a volume resistance of about $10^{10}$ ohms or less and has a polyolefin layer laminated onto the paper support. Due to this construction, the electrophotographic plate making material has the following advantages.

In the embodiment where the polyolefin laminate layer is directly formed on the paper support, no organic solvent is used in the formation of the polyolefin laminate layer and the conductivity or its uniformity of the paper support is not deteriorated. Therefore, in comparison with a polyethylene derivative coating formed in the presence of an organic solvent as described in Japanese Patent Application (OPI) No. 105580/80, the deterioration of the electrophotographic characteristics of the plate making material is less and an extremely good image quality can be secured. Japanese Patent Application (OPI) No. 14804/79 discloses the formation of a precoat layer by coating an aqueous dispersion prepared by mixing an emulsion of low molecular weight polyethylene, an aqueous dispersion of fine polyethylene particles or an emulsion of self-emulsifiable polyethylene with carbon black. In this method, the coating dispersion penetrates the paper support and makes it difficult to form a microscopically uniform thin film of carbon black or polyethylene. In addition, the components of the dispersion tend to precipitate during manufacturing and the properties of the product, e.g., waterproofness or the adhesive strength between the paper support and precoat, are not satisfactory. The present invention can overcome the defects by formation of the polyolefin layer by the lamination method.

In either embodiment where the polyolefin laminate layer is formed directly on the paper support or through a layer of a polyethylene derivative, the polyolefin laminate layer has an extremely high water repellency so that it provides an electrophotographic plate making material having excellent dimensional stability as compared with the conventional product. Japanese Patent Application (OPI) No. 28241/73 discloses an electrophotographic sensitive material having an aluminum foil and polyethylene layer which are interposed between the paper support and the photoconductive layer. According to the present invention, the electroconductive material is incorporated in the polyolefin laminate layer in an amount sufficient to provide a substrate having a volume resistance of about $10^{10}$ ohms or less. This eliminates the necessity to provide a conductive layer as an additional layer and reduces the production cost and the number of steps involved in the manufacturing process. As another advantage, no crackings occur due to the deposition of an aluminum foil as an intermediate layer as in Japanese Patent Application (OPI) No. 28241/73.

The electrophotographic plate making material of the present invention has the following performance advantages: the printing durability is remarkably improved and at least 10,000 sheets of printed copies can be obtained; the sensitivity change due to variations in temperature and moisture conditions during exposure is less and an excellent image quality can be obtained. For instance, it is capable of reproducing a dot image of 133 lines per inch by the wet development method; the material is highly adapted to processing with an automatic plate making machine and all necessary steps including exposure, development, fixing and treatment with a desensitizing solution can be accomplished in one automatic plate making machine without producing a defective plate due to, for example, improper transport.

The present invention is now described in greater detail by reference to the following examples. Unless otherwise indicated, all percents, parts, ratios and the like are by weight.

EXAMPLE 1

A 5% aqueous solution of polyvinyl benzyltrimethylammonium chloride was coated onto a high quality paper (basis weight: 100 g/m$^2$) in a coverage of 20 g/m$^2$ and dried to produce a conductive paper support. To both surfaces of the paper support, an aqueous latex of an ethylene-methyl-acrylate-acrylic acid copolymer (weight ratio=65:30:5) was applied to give a dry thickness of 0.2 g/m$^2$ and dried. A layer was laminated in a thickness of 25$\mu$ on both surfaces of the copolymer layer by extruding pellets (melt index: 3) prepared by melting and kneading a mixture of 85% polyethylene (density: 0.92 g/cm$^3$; average molecular weight: 22,000; softening point: 112° C.) and 15% conductive carbon black to obtain a substrate. The resulting substrate had a volume resistance of $10^8$ ohms. One surface of the polyethylene laminate layer was treated by corona discharge at 5 kVA.sec/m$^2$. A solution of the following composition was coated on the treated surface using a wire bar in a dry thickness of 1 g/m$^2$ and dried to form an intermediate layer.

| | |
|---|---|
| Colloidal Alumina (15% aqueous solution) | 50 parts |
| Colloidal Silica (20% aqueous solution) | 20 parts |
| Polyvinyl Acetate Emulsion ("Cebian A", a product of Daicel Ltd.) | 150 parts |
| Surfactant ("Amisole CDC", a product of Kawaken Fine Chemicals Col, Ltd.) | 0.1 part |
| Water | 100 parts |

A photoconductive layer was formed on the intermediate layer by applying a coating solution of the following formulation in a dry coverage of 20 g/m$^2$ and dried to obtain an electrophotographic plate making material.

| | |
|---|---|
| Photoconductive Zinc Oxice ("Sazex 2000", a product of Sakai Chemical Industry Co., Ltd.) | 100 parts |
| Silicone Resin ("KR-211", a product of Shinetsu Chemical Industries, Co., Ltd.) | 35 parts |
| Rose Bengal | 0.1 part |
| Fluorescein | 0.2 part |
| Methanol | 10.0 parts |
| Toluene | 150.0 parts |

The thus prepared electrophotographic plate making material was allowed to stand in a dark place at 25° C. and 45% R.H. for 12 hours and then a lithographic printing plate was made from the material using an Itek Model 135 plate making machine (Itek Corporation). The plate was desensitized with an etching solution (Addressograph Multigraph Corporation) and set on an offset printing machine, Hamada Star 700. More than 10,000 copies of a half-tone image reproducing 133 lines per inch were obtained.

EXAMPLE 2

Both surfaces of a conductive paper support as described in Example 1 were subjected to corona discharge treatment at 5 kVA.sec/$m^2$ and a polyethylene laminate layer was formed on the surfaces in the same manner as in Example 1. The resulting substrate has a volume resistance of about $10^8$ ohms. An electrophotographic plate making material was prepared by repeating the procedures of Example 1 of the corona discharge treatment to one surface of the polyethylene laminate layer, formation of an intermediate layer and a photoconductive layer.

A lithographic printing plate was produced from the material in the same manner as in Example 1 and set on an offset printing machine. 10,000 copies having good quality could be obtained.

EXAMPLE 3

A lithographic printing plate was prepared in the same manner as in Example 1 except that the polyethylene laminate layer was made from molten pellets of a mixture of 10 parts of polyethylene (density: 0.92 g/$cm^3$; average molecular weight: 22,000; softening point: 112° C.) and 10 parts of titanium oxide (average particle size: 0.5μ; specific volume resistance: $10^2$ ohms.cm). The substrate had a volume resistance of $10^9$ ohms. The plate was capable of producing 10,000 copies having good quality.

EXAMPLE 4

Both surfaces of a conductive paper support as described in Example 1 were subjected to corona discharge treatment at 5 kVA.sec/$m^2$ and a polyethylene laminate layer was formed on the surfaces in the same manner as in Example 1. The resulting substrate had a volume resistance of about $10^8$ ohms. An electrophotographic plate making material was prepared by repeating the procedures of Example 1 of the corona discharge treatment to one surface of the polyethylene laminate layer and formation of a photoconductive layer.

A lithographic printing plate was produced from the material in the same manner as in Example 1 and set on an offset printing machine. 10,000 copies having good quality could be obtained.

While the invention has been described in detail and with reference to specific embodiments thereof, it will be apparent to one skilled in the art that various changes and modifications can be made therein without departing from the spirit and scope thereof.

What is claimed is:

1. In a process of preparing a lithographic printing plate comprising uniformly charging a photoconductive layer of an electrophotographic plate-making material, subjecting the charged plate making material to imagewise exposure, developing the imagewise exposed plate-making material to form a toner image, fixing the toner image and treating the photoconductive layer with a desensitizing solution to render the non-toner image area hydrophilic to thereby produce the lithographic printing plate, the improvement characterized in that said plate making material comprises:

a substrate comprising a paper support and a polyolefin laminate layer containing an electroconductive material on at least one surface thereof and having a volume resistance of $10^{10}$ ohms or less, and a photoconductive layer on said substrate.

2. The process as claimed in claim 1 wherein an intermediate coating comprising a resin and a colloidal material selected from the group consisting of silica and alumina is present between said polyolefin laminate layer and said photoconductive layer.

3. The process as claimed in claim 1, wherein said polyolefin of said polyolefin laminate layer is a polyethylene or a polypropylene.

4. The process as claimed in claim 3, wherein said polyethylene is a polyethylene having a density of about 0.92 to 0.96 g/$cm^3$, an average molecular weight of about 20,000 to 50,000, a softening point of about 110° to 130° C., a tensile strength of about 130 to 300 kg/$cm^2$ and a specific volume resistance of about $10^{15}$ ohms.cm or more and said polypropylene is a polypropylene having a density of about 0.85 to 0.92 g/$cm^3$, a softening point of about 75° to 170° C., a tensile strength of about 280 to 420 kg/$cm^2$ and a specific volume resistance of about $10^{15}$ ohms.cm or more.

5. The process as claimed in claim 3 wherein said polyolefin of said polyolefin laminate layer is polyethylene.

6. The process as claimed in claim 1, wherein the polyolefin laminate layer contains as the electroconductive material oxides of metals selected from the group consisting of zinc, magnesium, tin, barium, indium, molybdenum, aluminum, titanium and silicon or carbon black.

7. The process as claimed in claim 1, wherein the volume resistance of said substrate is $10^8$ ohms or less.

8. The process as claimed in claim 1, wherein the volume resistance of said substrate is $10^6$ ohms or less.

9. The process as claimed in claim 1, wherein said polyolefin laminate layer is extrusion laminated onto said paper support.

10. The process as claimed in claim 1, wherein said photoconductive layer comprises a photoconductive material in a binder, said photoconductive material being an inorganic photoconductive material or an organic photoconductive material.

11. The process as claimed in claim 10, wherein said inorganic photoconductive material is zinc oxide, cadmium sulfide or titanium oxide and said organic photoconductive material is a phthalocyanine dye or a polycinnamic acid compound.

12. The process as claimed in claim 2, wherein said intermediate coating includes colloidal alumina or colloidal silica.

13. The process as claimed in claim 2, wherein said resin is selected from the group consisting of polyethylene terephthalate, polyimide, polycarbonate, polyacrylate, polymethyl methacrylate, polyvinyl fluoride, polyvinyl chloride, polyvinyl acetate, polystyrene, stryene-butadiene copolymers, polymethacrylate, silicone resins, chlorinated rubbers, epoxy resins, pure and modified alkyd resins, polyethylmethacrylate, poly-n-butyl methacrylate, cellulose acetate, ketone resins, polyethylene, polypropylene, polyacrylonitrile, rosin derivatives, polyvinylidene chloride, nitrocellulose, phenol-formaldehyde resins, metacresol-formaldehyde resins, styrene-maleic anhydride copolymers, polyacrylic acid-polyacrylic acid amide copolymers, fumaric acid-ethylene glycol copolymers, methyl vinyl ether-maleic anhydride copolymers, acryloyl-glycine-vinyl acetate copolymers, polyvinyl-pyrrolidone, polyvinyl alcohol, polyamides, or halogenated styrenes.

14. The process as claimed in claim 2, wherein the colloidal material has a particle diameter of about 1 to 100 $\mu$m.

15. The process as claimed in claim 2, wherein said intermediate layer has a coverage of from about 0.01 to 10 g/m$^2$.

16. The process as claimed in claim 1, wherein the electroconductive material is an electroconductive metal oxide.

17. The process as claimed in claim 1, wherein the electroconductive material is present in an amount of about 5 to 30 wt % based on the weight of the polyolefin laminate layer.

* * * * *